US012110793B2

(12) United States Patent
McQuerrey et al.

(10) Patent No.: US 12,110,793 B2
(45) Date of Patent: Oct. 8, 2024

(54) AUTOMATED SYSTEM FOR FACE DRILL MACHINES

(71) Applicant: J.H. FLETCHER & CO., Huntington, WV (US)

(72) Inventors: Sean Joseph McQuerrey, Hurricane, WV (US); Muhammad Usama, Fort Collins, CO (US); Adam Richard Teator, Milton, WV (US)

(73) Assignee: J.H. FLETCHER & CO., Huntington, WV (US)

( * ) Notice: Subject to any disclaimer, the term of this patent is extended or adjusted under 35 U.S.C. 154(b) by 49 days.

(21) Appl. No.: 18/113,667

(22) Filed: Feb. 24, 2023

(65) Prior Publication Data

US 2023/0272671 A1 Aug. 31, 2023

Related U.S. Application Data

(60) Provisional application No. 63/313,814, filed on Feb. 25, 2022.

(51) Int. Cl.
*E21B 7/02* (2006.01)

(52) U.S. Cl.
CPC ..... *E21B 7/025* (2013.01); *E21B 7/022* (2013.01)

(58) Field of Classification Search
CPC ..... E21B 7/022; E21B 7/025
See application file for complete search history.

(56) References Cited

U.S. PATENT DOCUMENTS

| | | | | |
|---|---|---|---|---|
| 10,208,595 | B2 * | 2/2019 | Kouhia | E21C 35/24 |
| 10,392,863 | B2 * | 8/2019 | Muona | E21B 44/00 |
| 11,002,075 | B1 * | 5/2021 | McQuerrey | E21D 9/003 |
| 2009/0024142 | A1 * | 1/2009 | Ruiz Morales | A61B 34/37 606/130 |
| 2017/0067341 | A1 * | 3/2017 | Baiden | B25J 11/00 |
| 2020/0128721 | A1 * | 4/2020 | Lewis | G01N 33/24 |
| 2020/0353495 | A1 * | 11/2020 | Kendall | B05B 13/0431 |
| 2022/0162911 | A1 | 5/2022 | Pesola | |
| 2023/0349292 | A1 * | 11/2023 | McQuerrey | E21D 20/003 |

FOREIGN PATENT DOCUMENTS

| | | | | |
|---|---|---|---|---|
| AU | 2018248806 | A1 * | 10/2019 | B25J 9/1666 |
| CN | 117891282 | A * | 4/2024 | G05D 3/12 |

* cited by examiner

*Primary Examiner* — Shane Bomar
(74) *Attorney, Agent, or Firm* — Dickinson Wright PLLC; Andrew D. Dorisio

(57) ABSTRACT

A drilling machine, including a drill and a boom, are used for drilling boreholes in the face of a mine. A sensor may scan the mine and create a virtual environment representing the mine based on that scan. The drilling machine may include a computer for moving the drill and the boom from a first position to a second position based at least partially on evaluation of the kinematic redundancy of the drill and boom. This may be used to avoid a collision in moving the drill and boom from the first position to the second position.

13 Claims, 12 Drawing Sheets

AUTOMATED SYSTEM FOR FACE DRILL MACHINES

This is a U.S. Non-Provisional patent application, claiming priority to U.S. Provisional Patent Application Ser. No. 63/313,814, filed Feb. 25, 2022, the disclosure of which is incorporated herein by reference.

TECHNICAL FIELD

This disclosure relates to the mining arts and, more particularly, to a mine drilling system and method for automatically or semi-automatically drilling a mine while avoiding collisions.

BACKGROUND

In tunneling, mining and excavation, including underground mining and excavation, it is common to drill holes in a face of rock or earth. For example, holes may be drilled into a face of rock, which may be filled with explosives for detonation and excavation. In addition, drilling may occur in a face or roof of a mine for insertion of a bolt, such as to support a shaft of the mine. Normally direction and orientation of drilling machines for such drilling procedures is done manually and relies on an operator's judgment as to where and how such holes may be drilled, including the orientation and direction of the drilled holes themselves.

In the case of a plurality of holes being drilled, operator judgment may lead to imprecise directions and endpoints within the rock face for each of the holes. This can lead to variations in the path of the mine passage, and an uneven rock face after blasting in the context of excavation. In addition, manual drilling of a rock face, roof, or wall, is generally slower than automated drilling. At least one reason for this slower nature of manual drilling is that uneven rock faces are normally scaled to dislodge loose rock. Rock faces that are blasted cleanly and evenly will have less loose rock hanging on the rock face. Such clean blasting is desired so that a resulting rock face after drilling and blasting is flat, thus enabling more accurate and easier continued excavation from the resulting rock face.

Additionally, in an underground mining or excavating environment, obstacles, including mechanical obstacles (such as various pieces of machinery that may be present) and natural obstacles (such as mine ribs, faces, ceilings, floors, etc.) may be irregular in shape and positions. Moreover, the space within an underground mining or excavation environment is often small. This can lead to inadvertent collisions or wasted time in operation of excavation machinery in order to avoid such collisions.

Accordingly, this disclosure contemplates a system and method of automating drilling of a mine face in order to achieve consistent and reliable results in the context of using a drilling machine to create drilled holes, saving time and increasing accuracy. Additionally, this disclosure contemplates a system for evaluating and/or automating the drilling process to avoid collisions within the mining or excavating environment.

SUMMARY OF THE INVENTION

In one embodiment, a system is disclosed for use in drilling one or more boreholes in a face of a mine. The system may include a drilling machine, which may have a drill for drilling the borehole, a boom for manipulating a position of the drill, and a plurality of actuators adapted to move the drill or the boom. The system may further include at least one sensor adapted to scan at least a portion of the mine for the creation of a topological image of the mine. The system may further include a computer configured to automatically move the drill and boom from a first position to a second position according to an algorithm based on the topological image of the mine, wherein the algorithm comprises determining a kinematic redundancy of the plurality of actuators prior to moving the drill and boom.

In one aspect, the sensor may comprise a LiDAR unit.

In another aspect, the computer may be adapted to move the drill in a 180 degree turn about a horizontal axis.

In a further aspect, the computer may be configured for determining if a collision will occur prior to moving the drill or boom from the first position to the second position. The topological image may comprise a three dimensional point cloud of the mine, and the determining may comprise analyzing a plurality of drilling vectors of points within the point cloud to evaluate whether any of said vectors will intersect.

In another aspect, upon determining a lack of kinematic redundancy, the algorithm may be further adapted to move the drill and boom to a third position with kinematic redundancy.

In an additional aspect, the algorithm may further comprise an iterative loop including evaluating a series of joint positions of the drilling machine between the first position and the second position, initiating movement of the drill and boom according to the series of joint positions, and determining if a collision is imminent. Upon determination that a collision is not imminent, the algorithm may further comprise returning to the evaluating step and continuing movement of the drill and boom according to the series of joint positions until the second position has been reached. Upon determining that a collision is imminent, the algorithm may further comprise the step of either waiting for an obstacle to be moved before returning to the evaluating step or initiating movement of the obstacle.

In another embodiment, a method is disclosed for use in drilling a plurality of boreholes in a face of a mine passage using a drilling machine including at least one drill, at least one boom, and a plurality of actuators adapted to move the drill or the boom. The method comprises the steps of scanning an environment of the mine to create a virtual environment representing at least a portion of the mine and at least a portion of the drilling machine, determining a kinematic redundancy of the plurality of actuators in moving the boom and drill from a first position to a second position, and upon determining a presence of kinematic redundancy for at least one of the actuators, automatically actuating the at least one actuator for moving the drill and boom from the first position toward the second position according to an algorithm based on the virtual environment.

In one aspect, the method further comprises the step of, upon determining a presence of no kinematic redundancy, moving the drill and boom to a third position in which kinematic redundancy is present.

In another aspect, the method further comprises the step of continuously monitoring the virtual environment for a potential collision based upon a vector analysis of movement of the drilling machine in the virtual environment. Upon determination of a potential collision, the method may further include the step of determining if an obstacle may be moved to avoid the potential collision, and moving said object if determined to be movable.

In a further aspect, movement of the boom and drill from the first position to the second position comprises rolling the boom and drill 180 degrees about a vertical axis.

In yet another aspect, the virtual environment comprises a point cloud image.

BRIEF DESCRIPTION OF THE DRAWINGS

The accompanying drawings incorporated in and forming a part of the specification, illustrate several aspects of this disclosure, and together with the description serve to explain the principles of the disclosure. In the drawings.

DETAILED DESCRIPTION

In the following detailed description, reference is made to the accompanying drawings that form a part hereof, and in which is shown by way of illustration, specific embodiments in which the invention may be practiced. These embodiments are described in sufficient detail to enable those skilled in the art to practice the embodiments and like numerals represent like details in the various figures. Also, it is to be understood that other embodiments may be utilized, and that process or other changes may be made without departing from the scope of the disclosure. The following detailed description is not to be taken in a limiting sense, and the scope of the invention is defined only by the appended claims and their equivalents. In accordance with the disclosure, an automated drilling system is hereinafter described.

Figure 1:
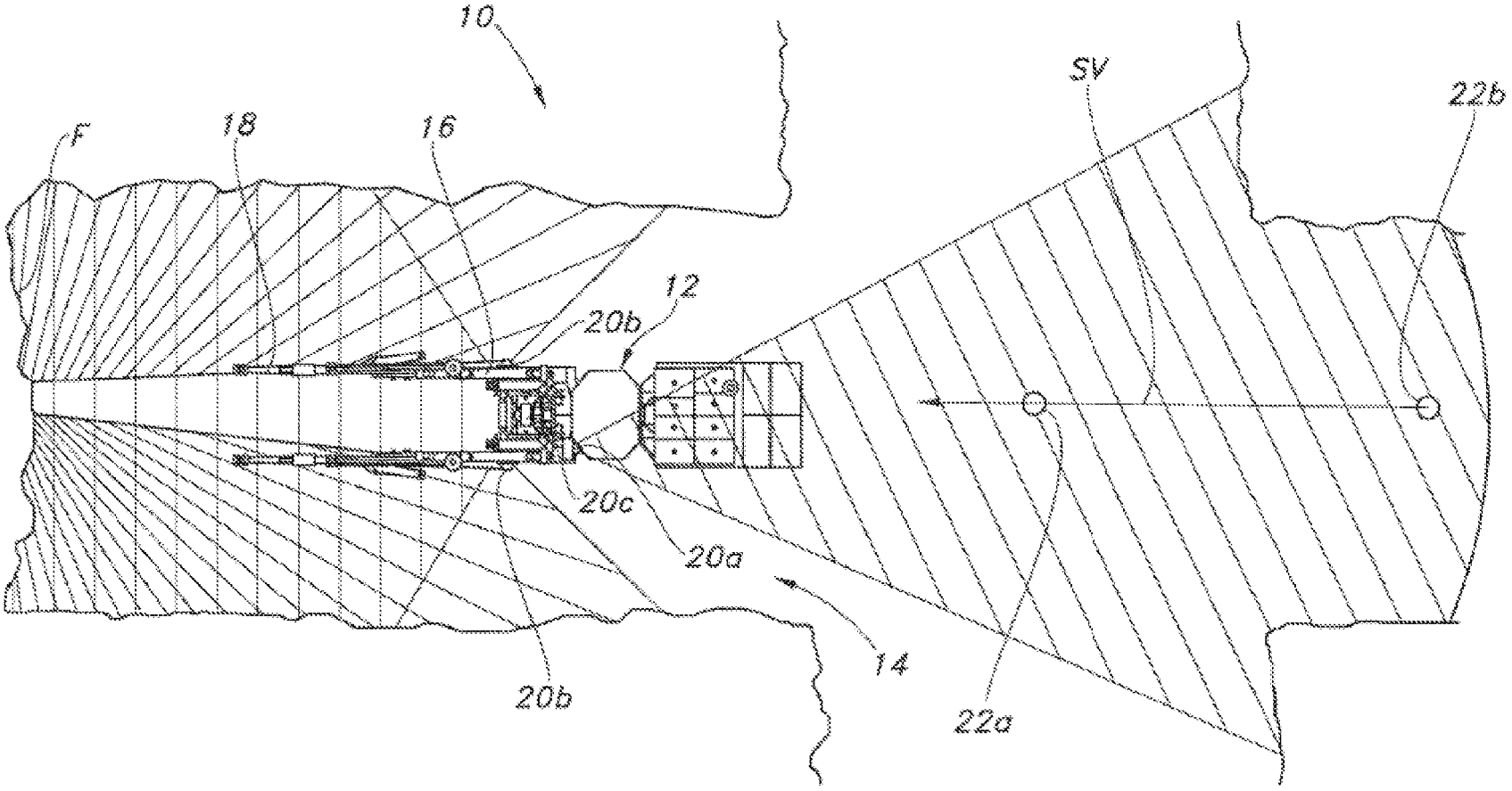
FIG. 1 is a top view of a drilling system forming one aspect of this disclosure.
Figure 2:
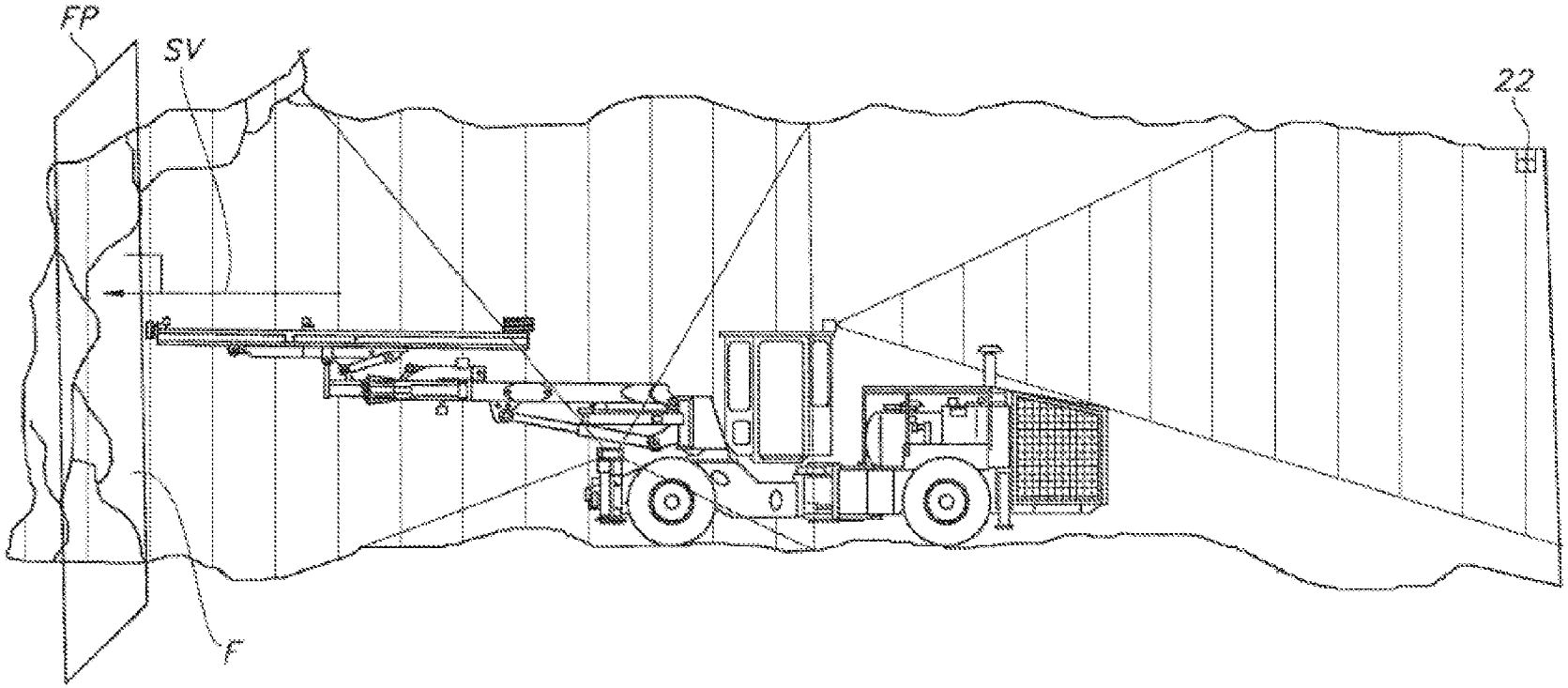
FIG. 2 is a side view of a drilling system forming one aspect of this disclosure.

With reference to FIGS. 1 and 2, a system 10 for drilling boreholes, or "holes," is disclosed. The drilling system 10 may be adapted for use in combination with a drilling machine 12 adapted for use in an underground mine passage 14. The drilling machine 12 may be of the "jumbo" type of wheeled vehicle common in the mining industry, but other types of drilling machines could also benefit from the disclosed concepts.

The drilling machine 12 may include one or more booms 16, which may be associated with one or more drill feeds 18. These booms 16 and drill feeds 18 may be manipulated to various positions with respect to the drilling machine 12 in order to access different portions of a face F of the mine to be drilled. For example, one or more actuators or controllers, such as hydraulic cylinders, may be associated with the boom 16 and/or the drill feed 18 to articulate the boom and drill feed at different angles and positions so as to access different portions of the face F to be drilled and to orient and position the drilled holes.

One or more sensors 20 may be used to sense an aspect of the environment surrounding the drilling machine 12, i.e. characteristics of the material to be drilled, such as location and/or topography of the surface to be drilled. These sensors 20 may comprise a LiDAR-based sensor, which may communicate with and be controlled by a controller or computer 30 associated with the drilling machine 12, and in communication with a machine controller 40 (FIG. 3) for automatically controlling the drilling process (or alternatively, a display for displaying parameters of a drilling operation to an operator for manual drilling). A LiDAR unit 24 forming part of the sensor(s) 20 may be adapted to survey or model the environment adjacent the drilling machine 12, such as through the use of pulsed laser light. Specifically, the LiDAR unit may be adapted to measure reflected pulses of the laser light, which may be used to create a representation of the environment. In other aspects, the sensors 20 may comprise other technologies adapted for scanning and/or otherwise evaluating the environment surrounding the drilling machine 12, such as machine (computer stereo) vision. In one implementation, three LiDAR units may be used.

Figure 3:
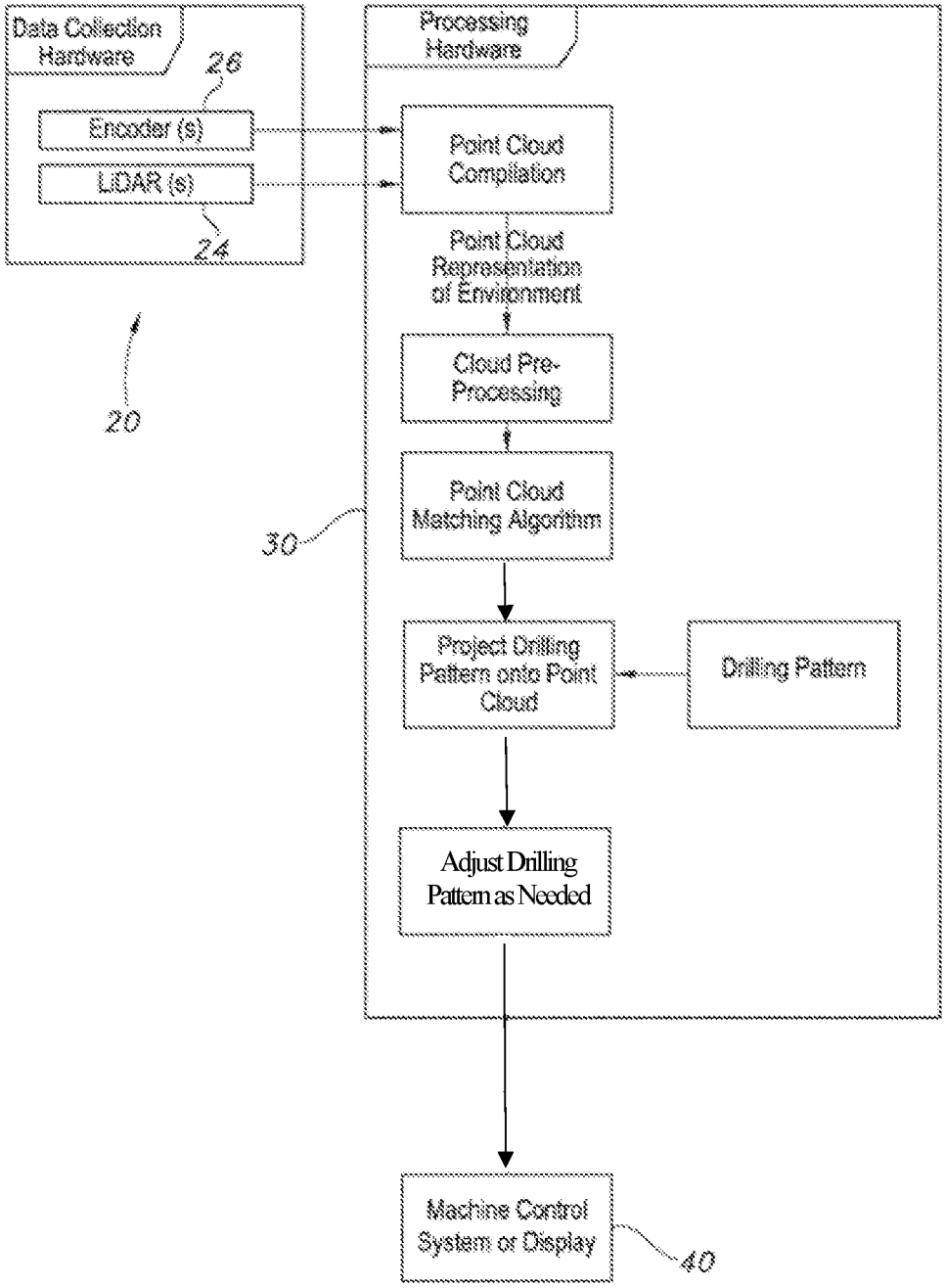
FIG. 3 is a flow chart of the acquisition of a point cloud image according to one aspect of this disclosure.

As indicated in FIG. 3, the LiDAR unit 24 may be mounted to a drive unit (motor), which may be rotatable, and may be coupled to an encoder 26. The LiDAR unit 24 may be adapted to create a plurality of 2-D scans of the environment, typically in the vertical direction. As the drive unit rotates, the LiDAR unit 24 may be adapted to take the plurality of 2D scans, which may be used to generate a 3-D cloud or representation of the environment (such as by reading the encoder 26 at approximately the same time as the LiDAR unit(s)). Alternatively, several laser/detector pairs may be provided on one LiDAR unit, resulting in 3-D scans being taken directly from the LiDAR, then rotated.

Figure 6:
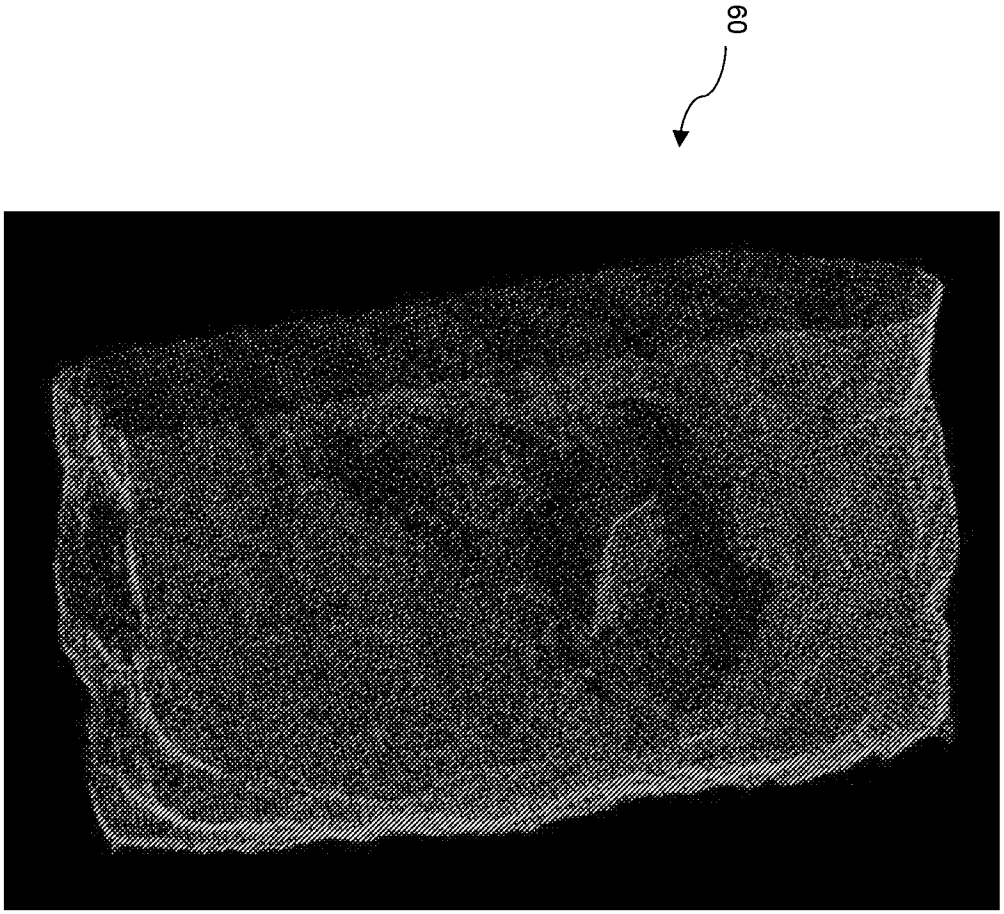
FIG. 6 is a point cloud topological image of a face of a mine.

As indicated in FIG. 3, cloud data obtained by sensor(s) 20 may optionally be pre-processed using algorithms such as statistical outlier removal, point rejection based on distance, and point rejection based on perceived intensity of the point reading. An algorithm may then be used to determine the whether the point cloud model is representative of the environment (such as using an iterative closest point algorithm). FIG. 6 illustrates an example of a point cloud generated image 60 of the topology of a face to be drilled in a mine environment.

Figure 4:
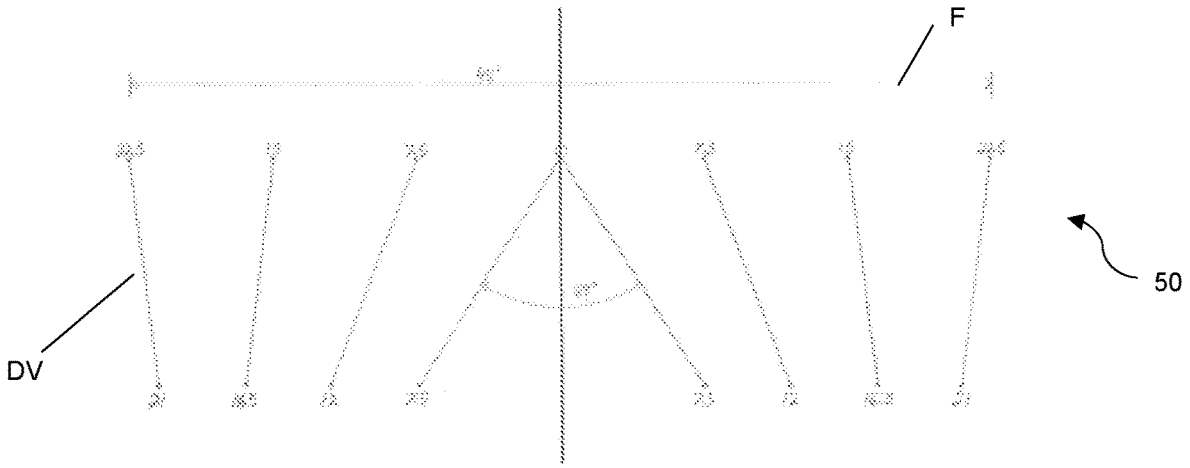
FIG. 4 is top view of an ideal drilling plan.
Figure 5:
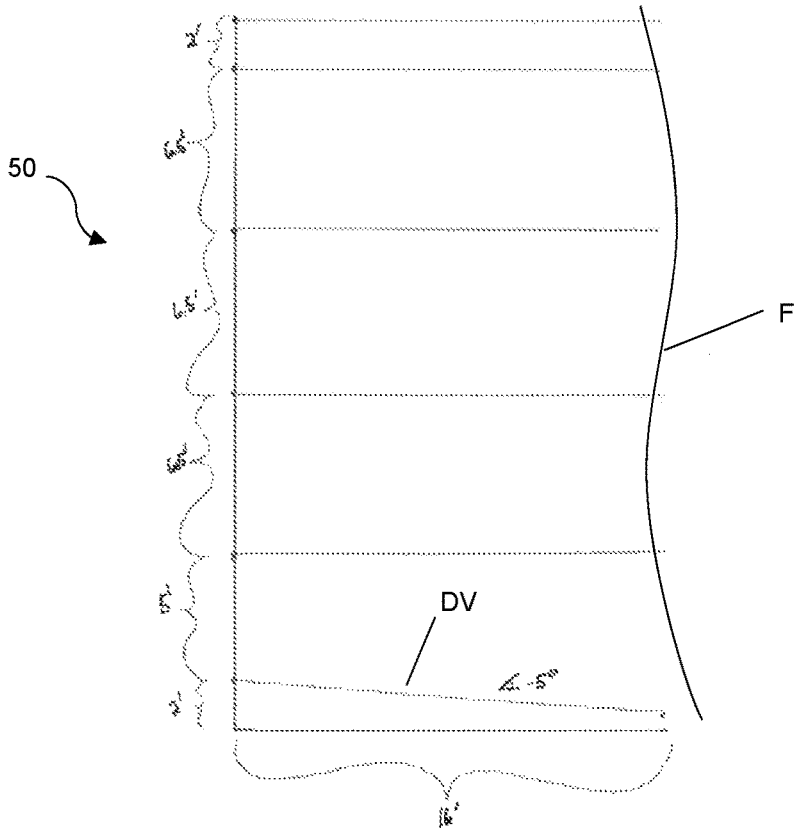
FIG. 5 is a side view of the ideal drilling plan.

In one aspect, the computer 30 may be adapted to receive a first drilling pattern or drill plan for drilling a set of holes in the face of a mine. This first drill plan may comprise an ideal drill plan, such as a drill plan assuming that the face of the mine is flat, or may comprise a drill plan based on a previous assessment of a face of the mine. FIG. 4 illustrates a top plan view of an ideal drill plan 50, while FIG. 5 illustrates a side elevational view of the ideal drill plan 50. The ideal drill plan 50 includes a plurality of drilling vectors DV defining a path of the one or more drills into the face F of the mine. The drilling vectors DV may be oriented at particular angles with respect to a vertical and a horizontal plane of reference as illustrated.

Figure 7:
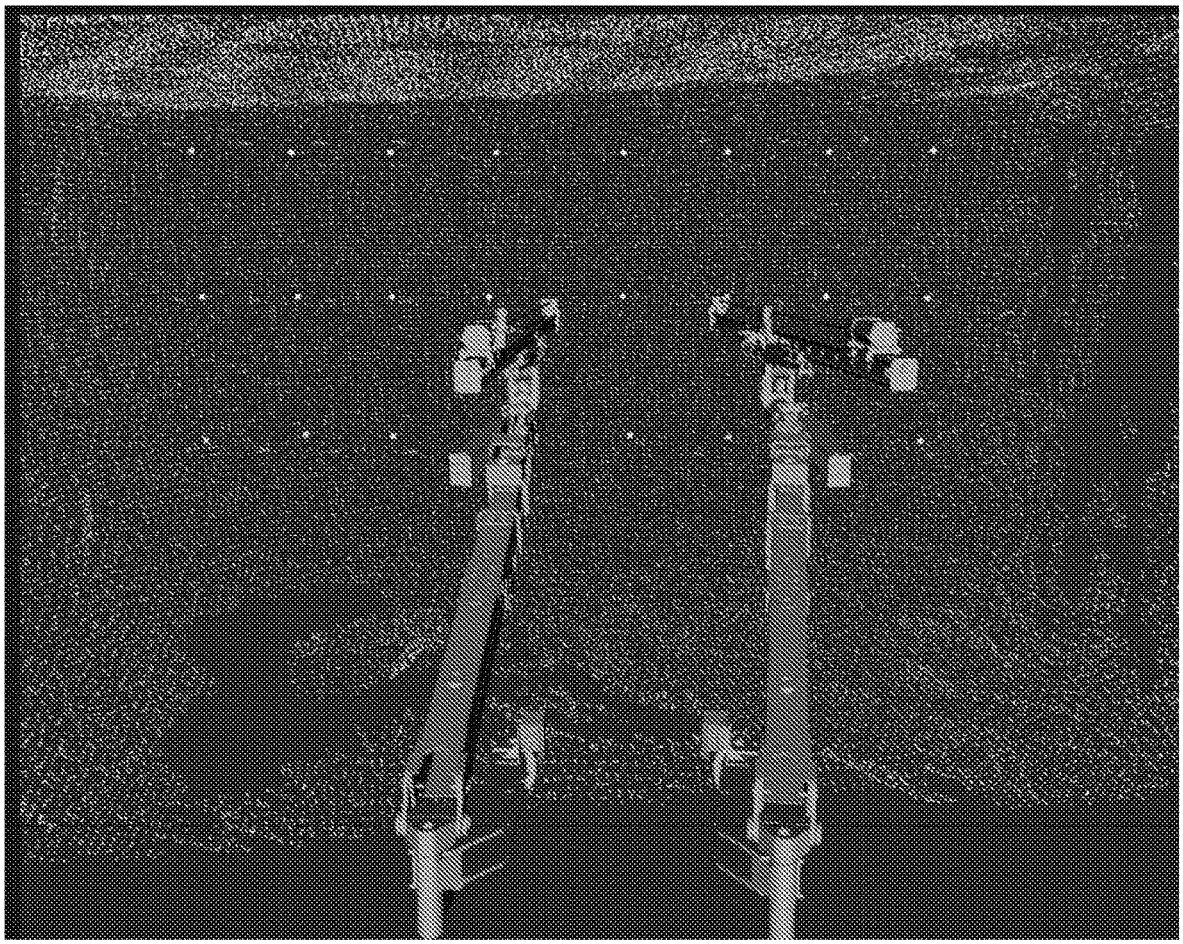
FIGS. 7 and 8 illustrate a modified drilling plan in view of the point cloud topological image of the face of the mine.
Figure 8:
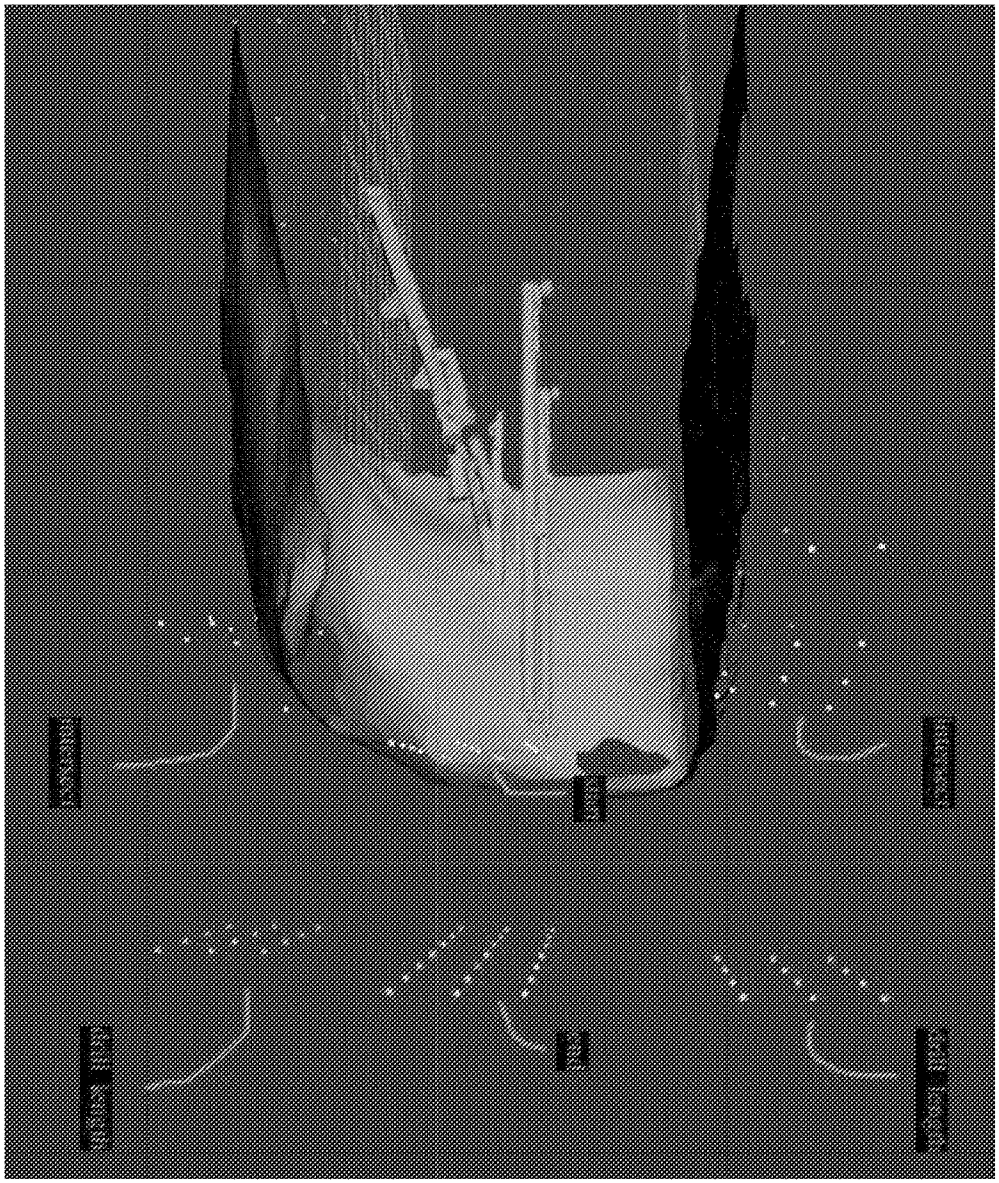
Figure 11:
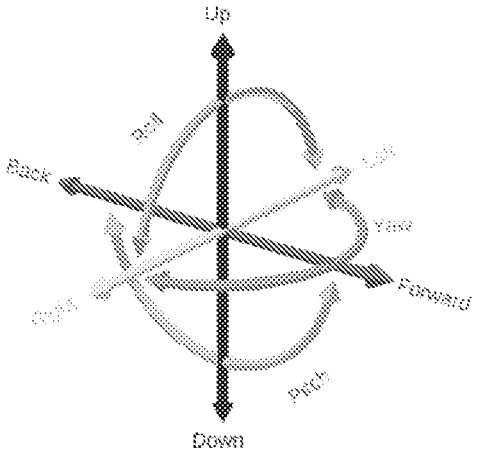
FIG. 11 illustrates the 6 degrees of freedom of motion.

With reference to FIGS. 7 and 8, the computer 30 may be adapted to compare the first drilling pattern to the scan of the face of the mine. As a first step, the ideal drill plan may be projected onto the virtual representation of the face of the mine. An algorithm may be used to adjust the drilling pattern as needed to account for the actual profile of the face from the scan, which may be different from the assumed flat face or previous assessment of the face associated with the first drilling pattern. The modified drill plan may become a script that includes coordinates of the holes needed to be drilled on the face. These coordinates may include position and orientation information, such as in terms of translation axis (X, Y, Z) and rotation axis (roll, pitch, and yaw), such as is illustrated in FIG. 11.

As shown in FIGS. 7 and 8, a modified drill plan may be overlayed with the scanned face of the mine. As can be seen in FIG. 8, the starting point of each drill point may be adjusted from the first drilling pattern to coincide with the scanned surface of the face of the mine. The modified drill pattern may be determined, whether manually or by the computer 30, such that all holes drilled in the face terminate in a coplanar configuration at the distal end of each hole drilled. The computer may be further adapted to display this modified drilling pattern, overlayed with the scan of the face, on a display, such as one that may be associated with the drilling machine or external to the drilling machine.

In a further aspect, the disclosure relates to the determination of a collision free path for the one or more booms to enact the drilling plan so as to avoid unwanted collision during the drilling process. Specifically, the computer 30 may be adapted to create the drilling pattern or drill plan so as to avoid self-collision within a boom, boom to boom collision in the context of a drilling machine with multiple booms, or a collision between boom and environment. Such coordination of boom movement is necessary in the inherently tight quarters and compact environment of a mine.

One or more position sensors may be associated with the or each boom so as to monitor boom position(s). The position sensors may comprise accelerometers, IR sensors, or any other sensor adapted to determine a position in space. Each position sensor may be in communication with the computer 30. In one embodiment, each boom may comprise a position sensor associated with each joint of the boom. The position sensors may be used to compute and/or visualize the pose or position of a given boom in the virtual environment of the scan created by the LiDAR sensors.

Figure 9:
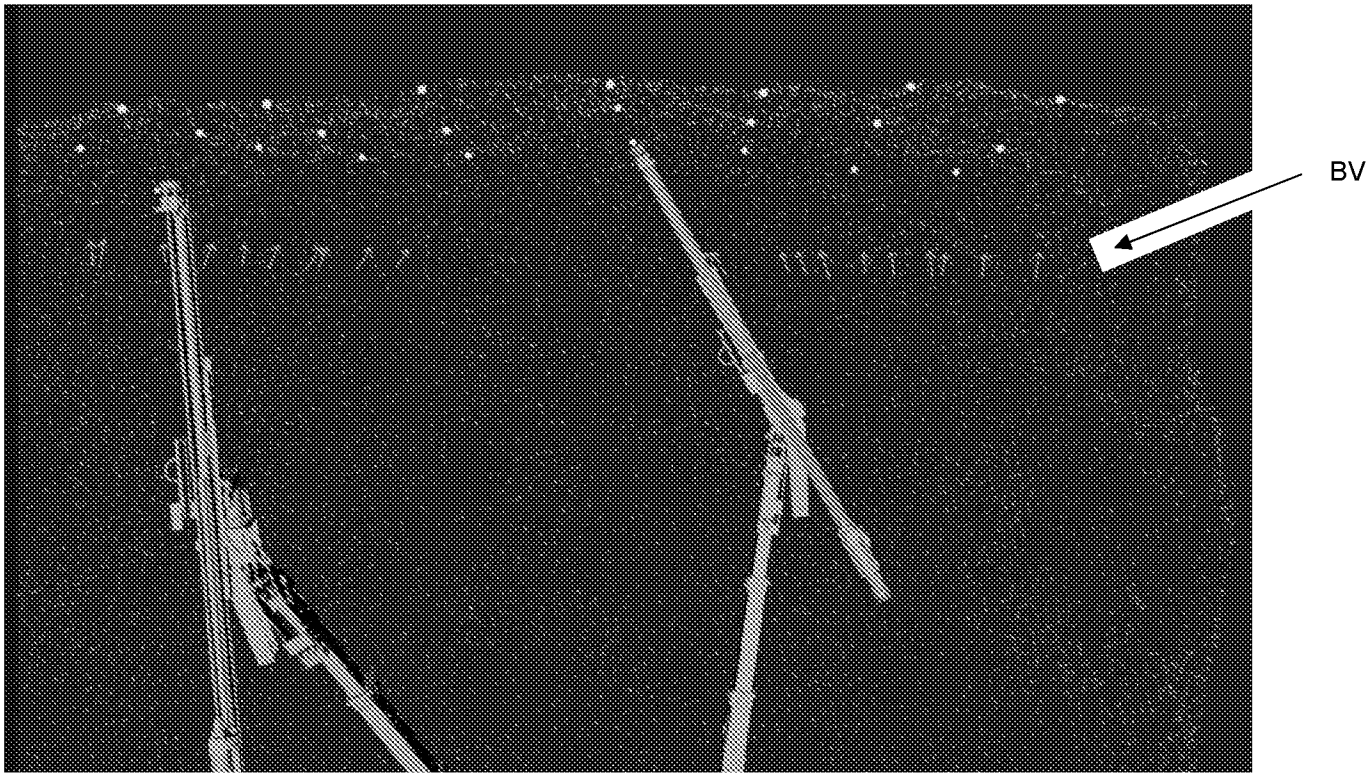
FIG. 9 is a point cloud image including boom vectors as part of the drilling plan.

As shown in FIG. 9, the computer 30 may be adapted to implement a control algorithm or control loop to produce a set of boom vectors BV or velocities for one or more actuators, such as hydraulic actuators, to manipulate the boom in a direction of the acquired target, or desired position of the boom, according to the drill plan. As each actuator implements motion to at least one portion of each boom, the boom vectors or velocities may be compared to the virtual environment to check for collisions within a boom, between booms, or between a boom and the environment.

Figure 10B:
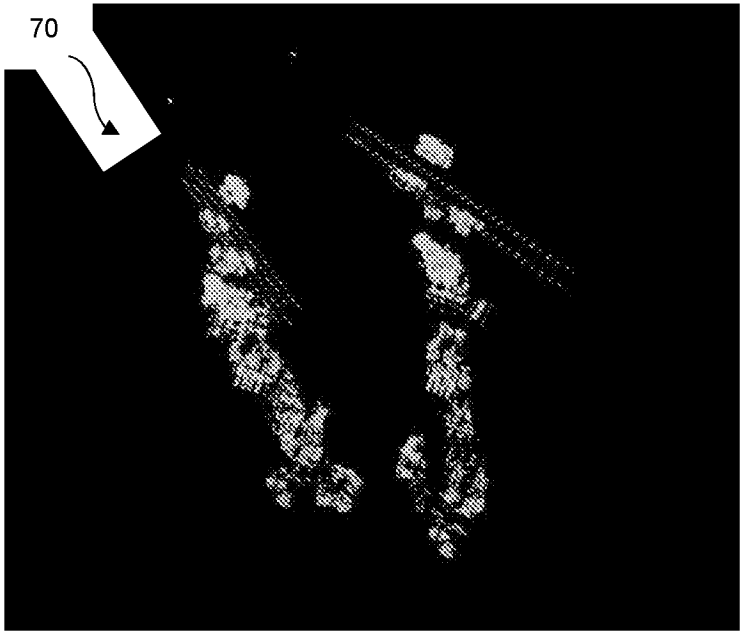
FIGS. 10A and 10B are point cloud images of the booms illustrating point-to-point distances between objects within the point cloud.
Figure 10A:
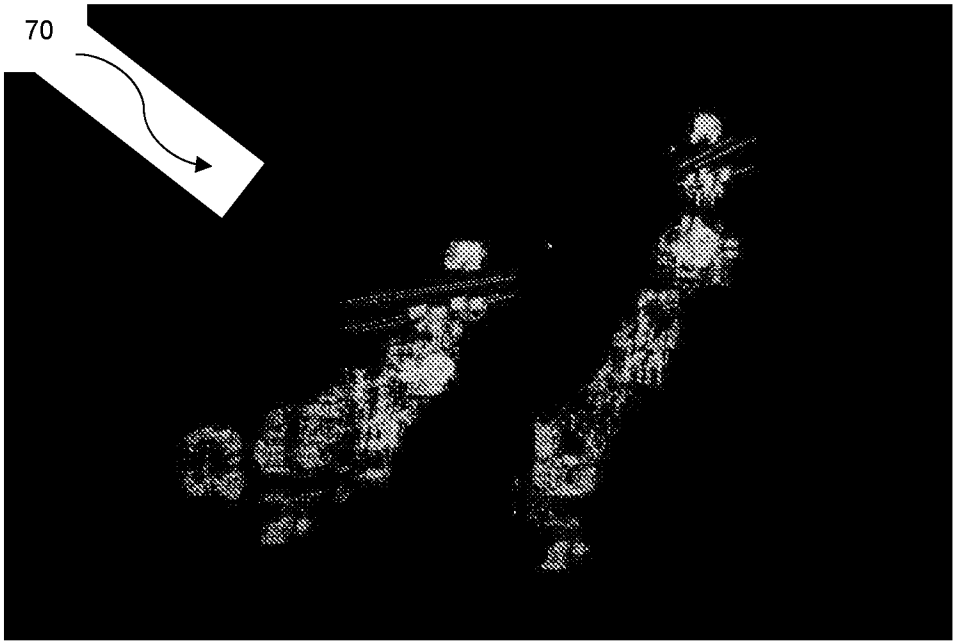

The various moving parts of each boom may be represented in the virtual environment, along with the other objects in the environment (e.g. rock face, rib, ceiling, or other objects within the mine). Each object (including the boom(s)) in the virtual environment may be represented in the point cloud 70, such as is shown in FIGS. 10A and 10B. Real time sensor data from the position sensors allow for visualization and modeling of the boom and its movements within the virtual environment.

A series of control cycles may be used to control movement of the boom(s). At each control cycle, an algorithm may be used for comparing the point-to-point distance of each cloud body. The point cloud structures (as shown in FIGS. 10A and 10B) may be used for comparing point-to-point distances of each cloud body in the virtual environment. This information may be used by the computer 30 in the decision making process of both whether the appropriate position has been reached by the boom and whether a collision pair exists between points within the point cloud. If a collision pair exists, the computer 30 may be adapted to modify movement of the boom so as to avoid the collision. For example, the computer 30 may calculate a unit vector in the direction of and away from the collision pair. The computer 30 may further be adapted to abort any command task that may result in a collision pair. Actuation of any relevant element of the boom(s) may be cut off by the computer in order to avoid such collision pairs. One or each of the control cycles may be conducted in the virtual environment before any movement of the boom is effected in the real environment of the mine. This allows the system to detect any possible collision before any such collision occurs, and therefore may eliminate the need for proximity sensors to detect impending collisions.

In one aspect, each joint of each boom may include a constraint on the range of motion of said joint. This constraint may be a maximum range of motion allowed mechanically by the construction of the joint and/or its actuator(s), or may be artificially imposed, such as by a user (e.g. entered into the computer 30) or determined by the computer, in order to define limits of allowed movement of a given joint. The computer 30 may use these joint positional limits in conducting the control cycles according to the algorithm.

Similarly, each joint of each boom may include a maximum velocity of joint movement. This maximum velocity may be inherent to the joint and its actuator(s) or may be imposed by a user or the computer. In each instance, the computer may account for these maximum ranges of motion and/or velocities associated with each joint in controlling boom and/or drill movement. This consideration of joint range of motion and/or velocity may be part of the control loop noted above, such that the computer prevents movements that may exceed these limits.

The above description relates to an automatic mode of operation in which the computer 30 is adapted to use the control algorithm in order to both operate the boom(s) according to the modified drill plan and to avoid collisions.

Figure 12:
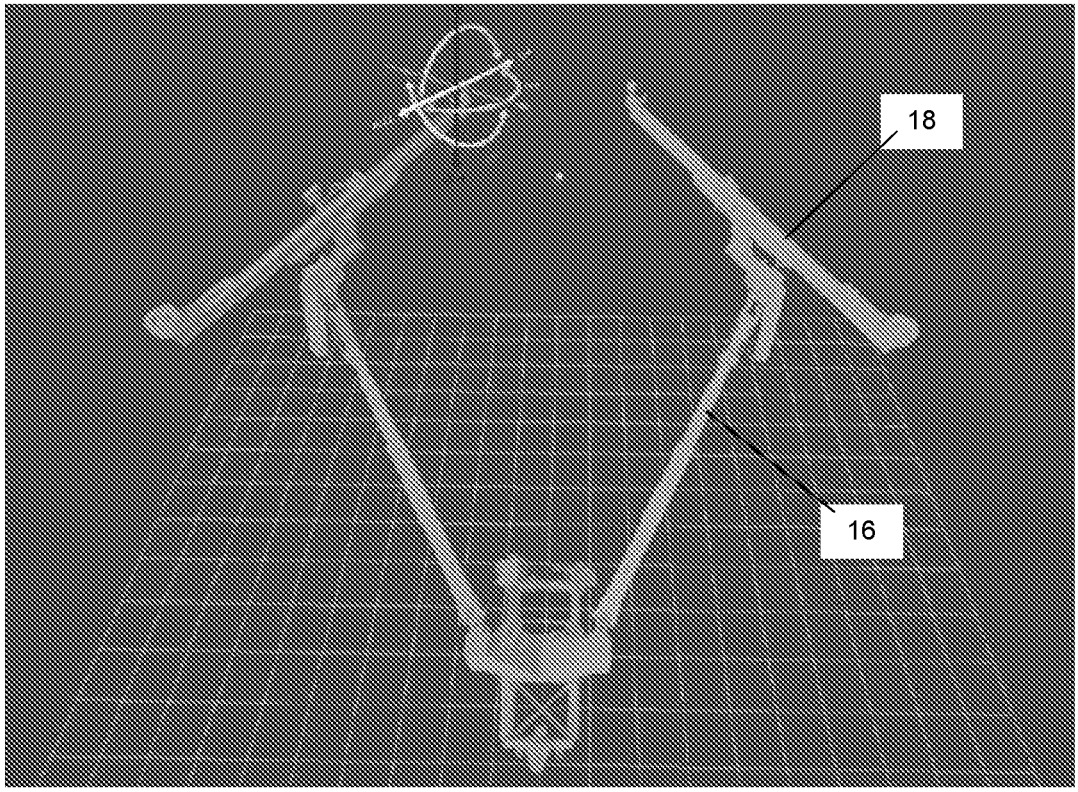
FIG. 12 illustrates the boom and drill that may be controlled for movement according to the 6 degrees of freedom.

In a further aspect of the disclosure, a semi-automatic mode of operation is disclosed. In the semi-automatic mode of operation, a user may control manipulation of multiple axes of motion of the boom 16 and/or drill 18 simultaneously. In one instance, the user may be allowed control over a plurality of the translational (i.e. X, Y, Z) and/or rotational (roll, pitch, and yaw) axes of motion, as illustrated in FIG. 12. The user may use a joystick, a touch screen, a keyboard, or other user input to initiate movement of the boom and/or drill. Such user control may allow for movement of multiple joints of the boom and/or drill simultaneously.

Once the computer receives the relevant inputs from the user, a control loop may be initiated (as described previously) that outputs command signals for joints to move which results in the drill being translated and rotated about its feed assembly. In this way, a user is not, themselves, required to control each joint separately.

In general, the movement of the drill (or other tool) is accomplished through primary and sometimes secondary tasks. The primary task may comprise the movement of the tool from a given or starting location to a target location. The secondary tasks may comprise collision avoidance (e.g. avoiding collision pairs as described herein), joint limit avoidance (e.g. avoiding exceeding physical limitations of joints in the boom and/or drill), and velocity limit avoidance (e.g. avoiding exceeding physical limitations of various actuators which manipulate joints of the boom and/or drill).

In an ideal situation comprising a collision free work space in which no joint is required to be pushed closed to its physical limits (both in terms of position and velocity), the Tool Center Point (TCP) of a boom or other tool may be moved from its starting location directly to the target coordinates. However, in the event of a detected pending collision, or in the event that a joint is determined to be near its physical limits, whether positional limits or velocity limits, priority will be given to avoiding the impending collision and/or the impending joint position or velocity limit. Thus, the controller may fluctuate between which movement assignments are given priority, depending on whether or not collisions and/or nearing of joint limits may occur. This change of priority between primary and secondary tasks is determined by a priority function carried out by the controller. Specifically, various individual tasks (i.e. movements of various parts of the boom and/or tool) are assigned to a given manipulator with a priority. The priority function dictates what task may be important and may take priority in a given configuration.

In certain aspects of the disclosure, the computer 30 is adapted to use one or more of kinematic redundancy and self-collision avoidance control in order to give the feed assembly a complete and safe ability to move from a first position to a second position (such as rotation, including 180 degrees or more, as described below) without collision. In the context of this disclosure, the term kinematic redundancy means that an actuator or other robotic manipulator has more degrees of freedom than those strictly required to execute a given task. Thus, this allows the manipulator the ability to use extra degrees of freedom to accomplish additional tasks, including but not restricted to, collision avoidance, joint position limit avoidance, and joint velocity limit avoidance.

In a scenario in which the priority of a primary task is the same as the priority of a secondary task, the drill will not move. This is because there is insufficient kinematic redundancy in the desired movement from point A to point B, such that there are insufficient available degrees of freedom to complete all tasks at hand, namely accomplishing the primary task without causing collision and/or a joint reaching its physical limits in terms of position and/or velocity. But if additional degrees of freedom are available (i.e. if there is kinematic redundancy), then the computer will direct the manipulators to utilize those additional degrees of freedom to accomplish those secondary tasks in a way that will allow the accomplishment of the primary task without collision or without reaching the limitations of a joint.

In certain instances, the structure of the drill demands that the drill feed assembly must rotate, including rotating 180 degrees or more, in order to access certain points of the drill plan. For example, lifter holes (which exist at the very bottom of the drill plan) may not be accessible with the feed assembly positioned in an upright configuration, but rather require that the feed assembly be "rolled over" to create such holes. Due to the structure of a drill, rotating to such a degree can cause a collision between the feed and the boom.

Figure 13:
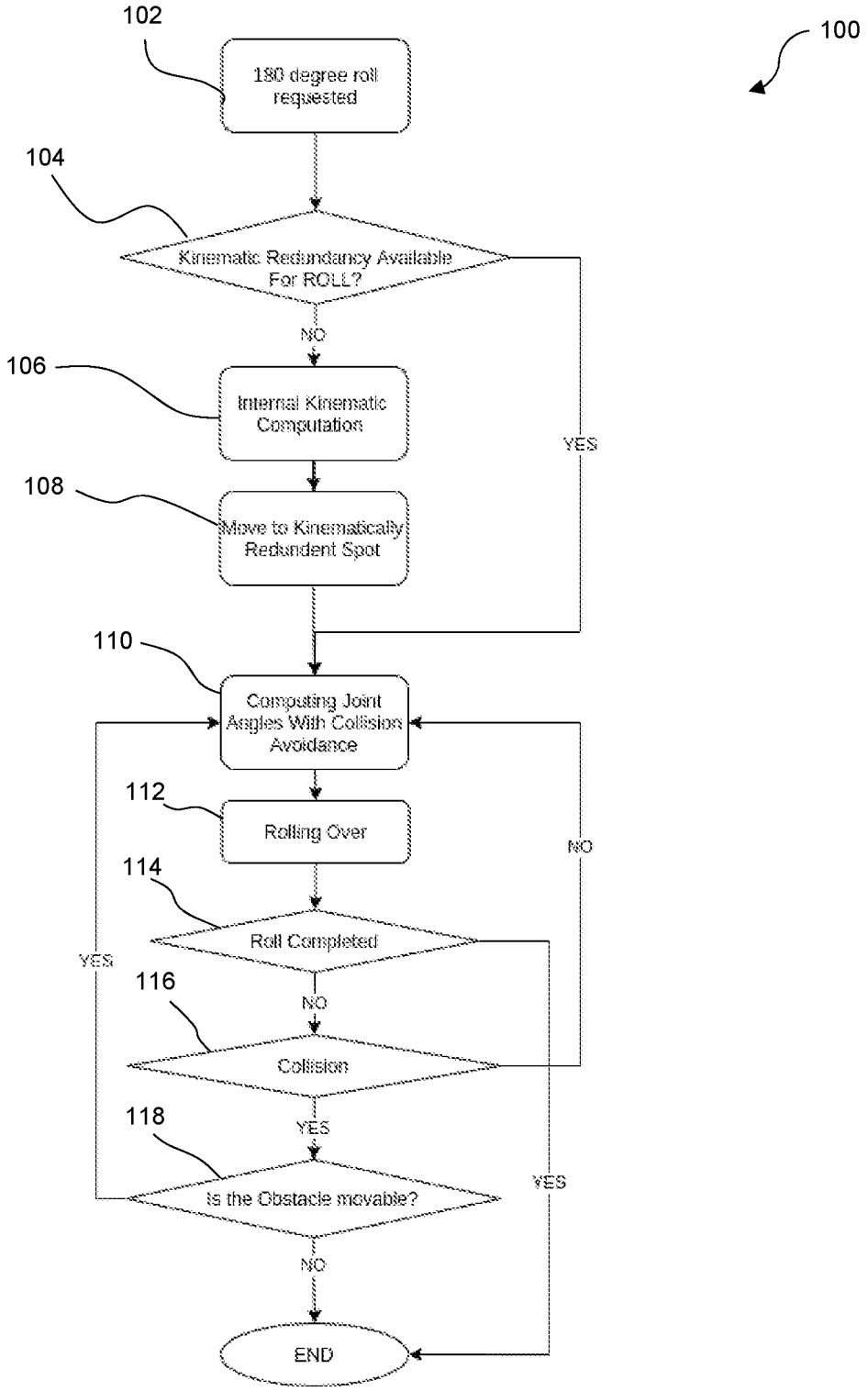
FIG. 13 is a flow chart of an algorithm for controlled, safe movement of the boom.

With reference to the flowchart of FIG. 13, an algorithm 100 is used to allow for 180 degree rotation of the drill without collision or reaching any joint limitations. In a first step 102, a request for a rotation, such as a 180 degree roll, is initiated. This request may be initiated by a user, or may be chosen by the computer, such as in the context of a fully automated mode of operation.

In a second step 104, the computer determines if kinematic redundancy is available in the current (or first) position of the drill and feed assemblies. If kinematic redundancy is available at the first position, then the algorithm may proceed to the fifth step 110, as discussed below.

If no such kinematic redundancy is available in the first position, then at a third step 106, the computer may conduct an internal kinematic computation to determine a second position, different from the first position, that would increase or maximize kinematic redundancy for the requested 180 degree roll. This third step 106 does not involve any actual movement of the drill and feed assemblies, but rather is an internal evaluation of potential paths of movement that the drill and feed assemblies may take from the first position to the second position. This internal evaluation of potential paths may be accomplished as discussed herein, considering collision avoidance, wherein the primary task is movement from the first position to the second position, and the secondary task includes collision avoidance.

For example, in this third step 106, the computer may evaluate movement of the drill and feed assembly from the first position to a home position and orientation (i.e. the second position in this example). The home position is a set of position and orientation coordinates in which the drill and feed assemblies are in line with each other, such as straight and on top of each other. This home position may comprise the drill and feed assemblies have substantially no relative deviation in their yaw (Z-axis) orientation and substantially no deviation in their relative pitch (Y-axis) orientation. These coordinates may have a relatively higher kinematic redundancy that other positions.

Once the computer has identified a second position that will result in increased or maximized kinematic redundancy, in a fourth step 108, the computer may activate the relevant manipulators or actuators to move relative joints to bring the drill and feed assemblies from the first position to the second position.

Once kinematic redundancy is determined to be available, whether as determined in the second step 104, or as achieved by way of the fourth step 108, the computer may proceed to an iterative loop to achieve the 180 degree roll.

This iterative loop begins with a fifth step 110, in which a series of joint positions, from the first (or second) position through to a final position in which the roll is completed, are generated by the computer. The computer may then start actuating the manipulators or actuators so as to manipulate the joints and begin the roll, as reflected in a sixth step 112. The computer may make a determination whether or not the roll has been completed at a seventh step 114. If the roll has been completed, then the iterative loop and the algorithm may end, with the drill and feed assemblies having reached a final position.

If it is determined in the seventh step 114 that the roll is not complete, then the computer will check to determine if a collision is imminent upon movement of the next step or movement of the drill and feed assemblies along the path toward the final position, as reflected in the eighth step 116. This may be accomplished via the determination of collision pairs, as discussed herein. If no collision is likely, then the computer will return in the iterative loop to the fifth step 110 to again generate a series of joint positions along a path to the final position and continue the movement of the drill and feed assemblies.

If, on the other hand, the computer determines in the eighth step 116 that a collision is imminent, then at a ninth step 118, the computer will determine if the object with which the drill or feed assemblies would collide (i.e. the obstacle) is moveable or not. If the obstacle is not moveable, then the computer will stop movement of the drill and feed assemblies along the requested roll. The algorithm (and movement of the drill and feed assemblies) will end without reaching the final position.

If, however, the computer determines at the ninth step 118 that the obstacle is moveable, then the computer may wait for the obstacle to be moved before continuing with the steps of the algorithm. In one aspect, the computer may initiate a request to a user to move the obstacle or to have the obstacle moved. Alternatively, the computer may automatically initiate the movement of the obstacle in response to a determination that the obstacle is moveable. Once the obstacle is moved, the computer may return in the iterative loop to the fifth step 110 to again generate a series of joint positions along a path to the final position and continue the movement of the drill and feed assemblies.

Figure 14:
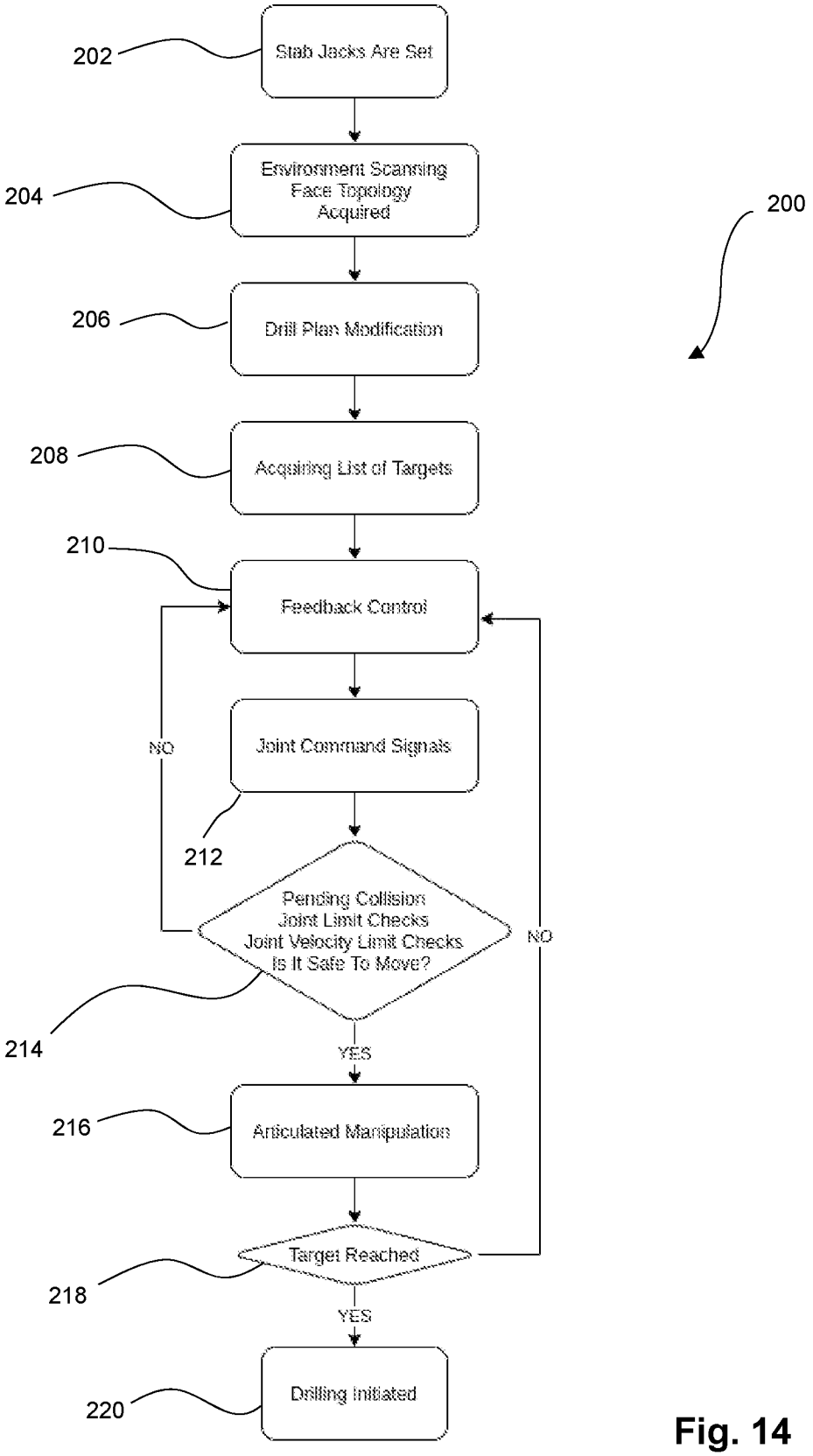
FIG. 14 is a flow chart of use of the control of boom movement in practice in a mine.

Turning to FIG. 14, a flowchart 200 of an example of an implementation of the system described herein is illustrated. At step 202, stabilization devices, such as stabilization jacks, may be set in the environment of the mine to be drilled. At step 204, the environment of the mine may be scanned, such as with LiDAR as described herein, and a topology of the face may be acquired. At step 206, a drill plan may be created or modified based on the topology of the face of the mine. A list of targets may be acquired at step 208. These targets may comprise positions and/or vectors for drilling into the face with the drill.

The computer may initiate the feedback control at step 210. At step 212, at least one command may be sent to a given joint of the boom or drill for the purpose of positioning the drill according to the drill plan.

At step 214, the computer confirms whether the joint command is a safe movement. This may include detecting any potential pending collisions (as described herein), checking any limits or limitations of a range of motion of a joint (whether mechanically or artificially imposed by a user or the computer), and/or checking any limits or limitations of a velocity of a joint (whether mechanically or artificially imposed by a user or the computer). If it is determined that the selected positioning command sent to the joint is not safe, then the feedback control loop reinitiates in order to select a new movement and/or to delay movement until any collision may be avoided by movement of an object in the environment. If it is determined that the selected positioning command sent to the joint is safe, then the positioning command is actuated, and the position of the boom and/or drill is actuated at step 216. At step 218, the computer may detect whether or not the target is reached. If not, then the computer may return to step 210 to again initiate the feedback control loop so as to continue the articulation of the boom until the target is reached. Once the computer determines that the target position of the drill has been reached, drilling may be initiated at step 220.

Each of the following terms written in singular grammatical form: "a", "an", and the", as used herein, means "at least one", or "one or more". Use of the phrase One or more" herein does not alter this intended meaning of "a", "an", or "the". Accordingly, the terms "a", "an", and "the", as used herein, may also refer to, and encompass, a plurality of the stated entity or object, unless otherwise specifically defined or stated herein, or, unless the context clearly dictates otherwise. For example, the phrases: "a unit", "a device", "an assembly", "a mechanism", "a component, "an element", and "a step or procedure", as used herein, may also refer to, and encompass, a plurality of units, a plurality of devices, a plurality of assemblies, a plurality of mechanisms, a plurality of components, a plurality of elements, and, a plurality of steps or procedures, respectively.

Each of the following terms: "includes", "including", "has", "having", "comprises", and "comprising", and, their linguistic/grammatical variants, derivatives, or/and conjugates, as used herein, means "including, but not limited to", and is to be taken as specifying the stated components), feature(s), characteristic(s), parameter(s), integer(s), or step(s), and does not preclude addition of one or more additional components), feature(s), characteristic(s), parameter(s), integer(s), step(s), or groups thereof. Each of these terms is considered equivalent in meaning to the phrase "consisting essentially of. Each of the phrases "consisting of and "consists of," as used herein, means "including and limited to".

The term "position," as used herein, means both a location within a set of coordinates, such as within a 3D Cartesian coordinate system, as well as an orientation of a given object within that coordinate system.

The phrase "consisting essentially of," as used herein, means that the stated entity or item (system, system unit, system sub-unit device, assembly, sub-assembly, mechanism, structure, component element or, peripheral equipment utility, accessory, or material, method or process, step or procedure, sub-step or sub-procedure), which is an entirety or part of an exemplary embodiment of the disclosed invention, or/and which is used for implementing an exemplary embodiment of the disclosed invention, may include at least one additional feature or characteristic" being a system unit system sub-unit device, assembly, sub-assembly, mechanism, structure, component or element or, peripheral equipment utility, accessory, or material, step or procedure, sub-step or sub-procedure), but only if each such additional feature or characteristic" does not materially alter the basic novel and inventive characteristics or special technical features, of the claimed item.

The term "method", as used herein, refers to steps, procedures, manners, means, or/and techniques, for accomplishing a given task including, but not limited to, those steps, procedures, manners, means, or/and techniques, either known to, or readily developed from known steps, procedures, manners, means, or/and techniques, by practitioners in the relevant field(s) of the disclosed invention.

Terms of approximation, such as the terms about, substantially, approximately, etc., as used herein, refers to ±10% of the stated numerical value. "Generally" means as close to a characteristic as possible, such as "generally parallel" or "generally perpendicular."

The phrase "operatively connected," as used herein, equivalently refers to the corresponding synonymous phrases "operatively joined", and "operatively attached," where the operative connection, operative joint or operative attachment, is according to a physical, or/and electrical, or/and electronic, or/and mechanical, or/and electro-mechanical, manner or nature, involving various types and kinds of hardware or/and software equipment and components.

It is to be fully understood that certain aspects, characteristics, and features, of the invention, which are, for clarity, illustratively described and presented in the context or format of a plurality of separate embodiments, may also be illustratively described and presented in any suitable combination or sub-combination in the context or format of a single embodiment. Conversely, various aspects, characteristics, and features, of the invention which are illustratively described and presented in combination or sub-combination in the context or format of a single embodiment may also be illustratively described and presented in the context or format of a plurality of separate embodiments.

The invention claimed is:

1. A system for use in drilling one or more boreholes in a face of a mine, the system comprising:

a drilling machine including a drill for drilling the borehole;

a boom for manipulating a position of the drill; and a plurality of actuators adapted to move the drill or the boom;

at least one sensor adapted to scan at least a portion of the mine for the creation of a topological image of the mine; and a computer configured to automatically move the drill and boom from a first position to a second position according to an algorithm based on the topological image of the mine, wherein the algorithm comprises determining a kinematic redundancy of the plurality of actuators prior to moving the drill and boom.

2. The system of claim 1, wherein the at least one sensor comprises a LiDAR unit.

3. The system of claim 1, wherein the computer is adapted to move the drill in a 180 degree turn about a horizontal axis.

4. The system of claim 1, wherein the computer is further configured for determining if a collision will occur prior to moving the drill or boom from the first position to the second position.

5. The system of claim 4, wherein the topological image comprises a three dimensional point cloud of the mine, and the determining comprises analyzing a plurality of drilling vectors of points within the point cloud to evaluate whether any of said vectors will intersect.

6. The system of claim 1, wherein, upon determining a lack of kinematic redundancy, the algorithm is further adapted to move the drill and boom to a third position with kinematic redundancy.

7. The system of claim 1, wherein the algorithm further comprises an iterative loop comprising evaluating a series of joint positions of the drilling machine between the first position and the second position;

initiating movement of the drill and boom according to the series of joint positions; and determining if a collision is imminent;

wherein upon determination that a collision is not imminent, returning to the evaluating step and continuing movement of the drill and boom according to the series of joint positions until the second position has been reached; and wherein upon determination that a collision is imminent, the algorithm further comprises the step of either waiting for an obstacle to be moved before returning to the evaluating step or initiating movement of the obstacle.

8. A method for use in drilling a plurality of boreholes in a face of a mine passage using a drilling machine including at least one drill, at least one boom, and a plurality of actuators adapted to move the drill or the boom, the method comprising:

scanning an environment of the mine to create a virtual environment representing at least a portion of the mine and at least a portion of the drilling machine;

determining a kinematic redundancy of the plurality of actuators in moving the boom and drill from a first position to a second position;

upon determining a presence of kinematic redundancy for at least one of the actuators, automatically actuating the at least one actuator for moving the drill and boom from the first position toward the second position according to an algorithm based on the virtual environment.

9. The method of claim 8, further comprising the step of, upon determining a presence of no kinematic redundancy, moving the drill and boom to a third position in which kinematic redundancy is present.

10. The method of claim 8, further comprising continuously monitoring the virtual environment for a potential collision based upon a vector analysis of movement of the drilling machine in the virtual environment.

11. The method of claim 10, wherein upon determination of a potential collision, the method further includes the step of determining if an obstacle may be moved to avoid the potential collision, and moving said object if determined to be movable.

12. The method of claim 8, wherein movement of the boom and drill from the first position to the second position comprises rolling the boom and drill 180 degrees about a vertical axis.

13. The method of claim 8, wherein the virtual environment comprises a point cloud image.

* * * * *